US010293962B2

(12) United States Patent
Weinmann et al.

(10) Patent No.: US 10,293,962 B2
(45) Date of Patent: May 21, 2019

(54) METHOD AND DEVICE FOR FILLING PACKAGES WITH A PADDING MATERIAL IN BULK MATERIAL FORM

(75) Inventors: Thomas Weinmann, Dagersheim (DE); Giovanni Berardi, Ludwigsburg (DE)

(73) Assignee: B & W SOLUTIONS GMBH, Bietigheim-Bissingen (DE)

( * ) Notice: Subject to any disclaimer, the term of this patent is extended or adjusted under 35 U.S.C. 154(b) by 1168 days.

(21) Appl. No.: 13/984,505

(22) PCT Filed: Feb. 8, 2012

(86) PCT No.: PCT/EP2012/052134

§ 371 (c)(1),
(2), (4) Date: Oct. 28, 2013

(87) PCT Pub. No.: WO2012/107492

PCT Pub. Date: Aug. 16, 2012

(65) Prior Publication Data

US 2014/0157729 A1 Jun. 12, 2014

(30) Foreign Application Priority Data

Feb. 8, 2011 (DE) ..... 10 2011 000 561

(51) Int. Cl.
*B65B 23/00* (2006.01)
*B65B 55/20* (2006.01)
(Continued)

(52) U.S. Cl.
CPC ..... *B65B 7/28* (2013.01); *B65B 1/22* (2013.01); *B65B 55/20* (2013.01); *B65B 61/22* (2013.01)

(58) Field of Classification Search
CPC ..... B65B 55/20; B65B 81/09; Y10S 493/967
(Continued)

(56) References Cited

U.S. PATENT DOCUMENTS 4,562,686 A * 1/1986 Focke ..... B31B 1/25 493/183
5,826,725 A 10/1998 Hornstein et al.
(Continued)

FOREIGN PATENT DOCUMENTS

DE 603 06 407 T2 7/2007
EP 1 556 278 B1 7/2005
(Continued)

OTHER PUBLICATIONS

Co-pending U.S. Appl. No. 13/824,489, filed Jul. 3, 2013; inventor Hans Konnerth; title Method And Device For Filling Packets With Padding in The Form of Bulk Material.

*Primary Examiner* — Andrew M Tecco
*Assistant Examiner* — Eyamindae C Jallow
(74) *Attorney, Agent, or Firm* — Pauley Erickson & Kottis

(57) ABSTRACT

A method for filling packages or containers with a padding material, wherein the padding material is fed to the package or the container by way of a feed unit. Contour properties of one or more packing pieces in the package or in the container are determined by a scanning unit, are processed by a logic device and a filling quantity of that volume of the package or the container to be filled is determined therefrom and, derived therefrom, a variable quantity of padding material is introduced into the package or the container. In order for it to be possible to fill the packages or containers simply in an automated manner, an information item of an information carrier on the package or the container is read by a reading unit and an information item is determined therefrom with respect to the internal volume of the package or the container, wherein a highest point of the packing piece or the packing pieces is determined from the contour properties of the packing piece or the packing pieces and a first filling volume of padding material is determined therefrom,
(Continued)

which filling volume is required for filling as far as the highest point of the packing piece or the packing pieces. This invention also relates to a device for carrying out the method according to this invention.

19 Claims, 2 Drawing Sheets

(51) Int. Cl.
*B65B 7/28* (2006.01)
*B65B 61/22* (2006.01)
*B65B 1/22* (2006.01)

(58) Field of Classification Search
USPC ..... 53/115, 472; 206/521, 584; 700/240
See application file for complete search history.

(56) References Cited

U.S. PATENT DOCUMENTS 5,854,679 A * 12/1998 Bourgoin ..... G01B 11/00 356/620
5,864,404 A * 1/1999 Amorosi ..... G01B 11/00 356/627
5,871,429 A 2/1999 Harding et al.
7,337,595 B2 3/2008 Harding
2001/0017023 A1* 8/2001 Armington ..... B31D 5/0047 53/472
2002/0104293 A1* 8/2002 Armington ..... B65B 55/20 53/472
2004/0188309 A1* 9/2004 Kudou ..... B65D 81/07 206/521
2008/0092488 A1* 4/2008 Gabrielsen ..... B65B 55/20 53/428
2009/0064638 A1* 3/2009 Corbett ..... B65B 55/20 53/472
2009/0301038 A1* 12/2009 Gabrielsen ..... B65B 55/20 53/472

FOREIGN PATENT DOCUMENTS

EP 1 786 682 B1 5/2007
EP 2 204 325 A1 7/2010
WO WO 2004/041653 A1 5/2004
WO WO 2006/017602 A1 2/2006
WO WO 2006/050354 A2 5/2006
WO WO 2008/146111 A1 12/2008

* cited by examiner

METHOD AND DEVICE FOR FILLING PACKAGES WITH A PADDING MATERIAL IN BULK MATERIAL FORM

BACKGROUND OF THE INVENTION

Field of the Invention

This invention relates to a method for filling packages or containers with a cushioning material in which the cushioning material is supplied to the package or container by a supply unit, the contour properties of one or more packaged items in the package or container are determined by a scanner unit, processed by a logic unit, and based on this processing, a filling quantity of the volume of the package or container to be filled is determined and, derived from the latter, a variable quantity of cushioning material is dispensed into the package or container.

This invention also relates to a device that can be used to execute the above-mentioned method.

Discussion of Related Art

Particularly at mail-order companies, packages are usually individually filled according to customer wishes at a fully automated high bay warehouse. The articles ordered by the customer are placed into the package. Different package sizes are used depending on the number of articles to be placed in them. In order to prevent the articles inside from being damaged during postal transport, the remainder of the package is then filled with bulk cushioning material. In particular, foam peanuts are often used. As a rule, these foam peanuts are of a biodegradable material. They are dispensed into the package. The excess quantity is swept off so that the top surface is level with the top of the package. The package is then closed, labeled, and shipped. The swept-off cushioning elements are collected and prepared for filling subsequent packages. This manually executed packaging process is time-consuming and involves a significant amount of effort for collecting the excess foam peanuts.

German Patent DE 603 06 407 T2, as a translation of European Patent Reference EP 1 556 278 B1, describes a cavity-filling system for automatically preparing and dispensing a quantity of cushioning material, which is sufficient for filling the cavity remaining in a container into which one or more items have been placed. This cavity-filling system includes the following devices: a cushioning material dispenser able to dispense a controlled quantity of cushioning material, a container scanner which has a scanning region; the container scanner has a height sensor for detecting a height property of a container, a width sensor for detecting a width property of the container, a contour sensor for detecting a contour property of the one or more items in the container, and a logic unit that is able to process detected property information that have been received from the height sensor, the width sensor, and the contour sensor, in order to determine the quantity of cushioning material required to fill the remaining cavity in the container not occupied by the one or more items, and to instruct the cushioning material dispenser to dispense the determined quantity of cushioning material. Furthermore, the above-mentioned patent describes a device for automatically determining a quantity of cushioning material that is sufficient to fill the above-mentioned cavity.

It has in the meantime turned out to be disadvantageous that it is still first necessary to determine the volume of the package by a measurement device that requires a large number of additional sensors, which on the one hand increases the complexity of such a system and on the other hand, can be inconvenient when optimizing the throughput time. It has also turned out that a relatively high ratio of excess cushioning material still has to be dispensed.

SUMMARY OF THE INVENTION

One object of this invention is to reduce the complexity of such a system and to minimize the use of cushioning material.

Another object of this invention is to provide a corresponding device for executing the method according to this invention.

The above and other objects of this invention relating to this method is achieved when a piece of information of an information carrier on the package or container is read by a reading unit and used to determine a piece of information regarding the internal volume of the package or container. Based on the contour properties of the packaged item or packaged items, a highest point of the packaged item or packaged items is determined and this information is used to determine a first filling volume of cushioning material necessary for filling up to the highest point of the packaged item or packaged items.

The above and other objects of this invention relating to the device is attained if the device has a reading unit that can be used to determine information regarding the type and, derived from this, information regarding the internal volume of the package or container. The scanning unit can be embodied in the form of an optical laser scanner, which can use a triangulation process to determine a volume of the packaged item or packaged items and a highest point of the packaged item or packaged items and based on this information, it is possible to determine a first filling volume of cushioning material necessary for filling up to the highest point of the packaged item or packaged items.

The complexity of such a system can be reduced because this approach makes it possible to significantly simplify a previously complex determination of the internal volume of the package or container. The proposed method and the corresponding device of this invention can also determine the required cushioning material more precisely so that the use of cushioning material can be minimized to a meaningful degree. In addition to an optimal mechanical protection of the packaged items, the shipment volume can be minimized, which is advantageous in terms of shipping costs and waste disposal.

If in a second step, a second filling volume, beyond the highest point, is determined and, based on the filling volume determined in the first step, a total volume is calculated as the sum of the two filling volumes of cushioning material and the total volume of cushioning material is dispensed into the package or container, then it is possible to achieve an optimal protection of the packaged items in the package or container. This defined excess of cushioning material is used on the one hand to ensure that it is possible to provide enough cushioning material, for example to fill cavities between the packaged items. On the other hand, this ensures that enough cushioning material can be dispensed in to reach the top closure of the package or container.

In this instance, the second filling volume can be predetermined taking into account a filling material density and/or the property of the packaged item or packaged items. It is thus possible, for example, to increase the density of the cushioning material, for example when packaging heavy packaged items. It is thus possible to optimally fix items in position. With light-weight packaged items, however, the second filling volume can be reduced. The second filling volume can be selected in a customer-specific way or manner in accordance with the necessary specifications for packaging the packaged items.

Thus, in a preferred embodiment of the device of this invention, a second filling volume, beyond the highest point, can be determined based on the information regarding the type and internal volume and, based on the filling volume determined in the first step, a total volume can be calculated by the logic unit as the sum of the two filling volumes of cushioning material and the information regarding the calculated total volume of cushioning material can be transmitted to a metering unit of the supply unit. The metering unit then supplies the cushioning material volume individually required for the respective package. The supply unit then dispenses the cushioning material into the receiving container. This cushioning material is then dispensed into the package and the filling process is complete. If a larger volume than the maximum volume of the dispensing container is required, a multiple filling is possible.

The second filling volume in this case can be predetermined taking into account a filling material density and/or the property of the packaged item or packaged items. In this embodiment, the predetermined values can be stored in a memory unit of the logic unit, which contributes to a high degree of flexibility because the filling quantity can be varied as a function of the packaged item.

In another embodiment of the method of this invention, in another step after being filled with cushioning material, the package or container is set into a vibrating motion for a certain amount of time. This increases the density of the cushioning material, achieving a compact fixing of the position of the packaged items in the package or container.

In one embodiment of this invention, the device has a vibrating unit, which can be controlled by the logic unit, thus enabling an automated process.

Optionally, in another embodiment of the method of this invention, the package, which is composed of a scorable cardboard, is scored from the outside, the flaps thus produced are folded inward and a fitted lid for closing the package can be set in place. As a result, the package can be closed immediately after being filled.

In order to implement this embodiment of the method of this invention, the device can be equipped with or have a scoring device for externally scoring a package constructed of cardboard and the scoring device can be controlled by the logic unit. In addition, the device can be equipped with electromechanical or electropneumatic units for folding flaps produced by scoring the package of cardboard, which units can likewise be controlled by the logic unit. A corresponding control logic in the form of a process control can be implemented in the logic unit, thus making it possible to implement a complete, largely automated packaging process. This significantly reduces costs and time and offers particular advantages when there are a large number of items to be packaged.

If, as provided in different embodiments of the method of this invention, a machine-readable code in the form of a bar code or a 2-D pixel code or an RFID chip is used as the information carrier on the package or container, then the type of package or container can be identified with particular ease.

In the corresponding different embodiments of the device of this invention, the information regarding the type and internal volume on the package or container is embodied as a machine-readable code in the form of a printed or glued-on bar code or a 2-D pixel code or an RFID chip attached to the package or container and the reading unit communicates with the logic unit and consequently, the internal volume can be determined directly from the code by using a comparison table stored in the logic unit. This type of determination of the internal volume of the package or container is less time-consuming. In addition, costly sensor components of the kind that are customarily provided in the prior art can be avoided, which reduces the investment required for such a packaging device.

It has turned out to be particularly advantageous if, as the cushioning material, foam peanuts composed of or of a recyclable foam material, in particular cornstarch, are used, which are embodied as essentially cylindrical and have a diameter in a range from 10 mm to 20 mm, preferably a diameter in the range between 13 mm and 19 mm, and have an axial length of 10 mm to 50 mm, preferably in a range between 20 mm and 40 mm. These foam peanuts are easy to dispense and do not have a tendency to jam in the mechanism of the filling device. In addition, these foam peanuts can be composed of or of plant-based materials and are completely biodegradable.

BRIEF DESCRIPTION OF THE DRAWINGS

This invention is explained in greater detail in view of an exemplary embodiment shown in the drawings, wherein.

DETAILED DESCRIPTION OF THE INVENTION

Figure 1:
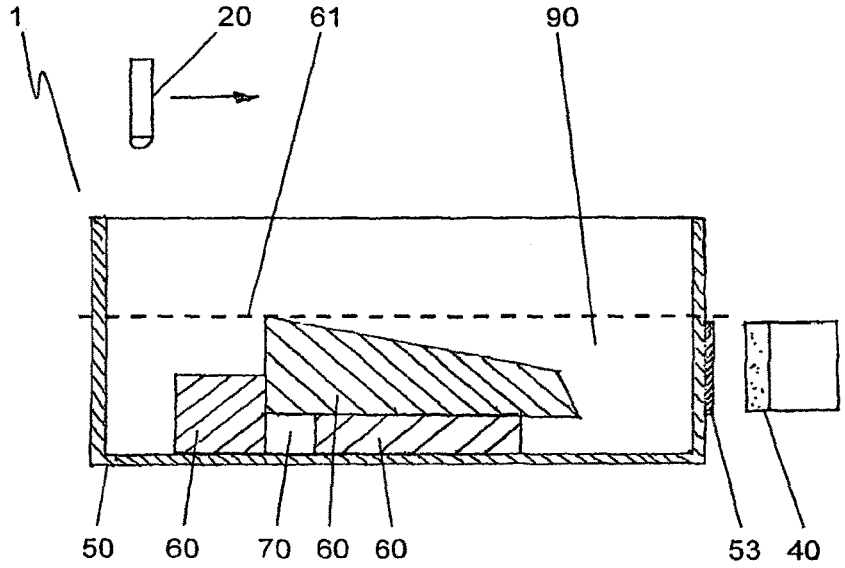
FIG. 1 schematically shows the steps of a method according to this invention, starting with the scanning of the data regarding a package volume of a package.
Figure 2:
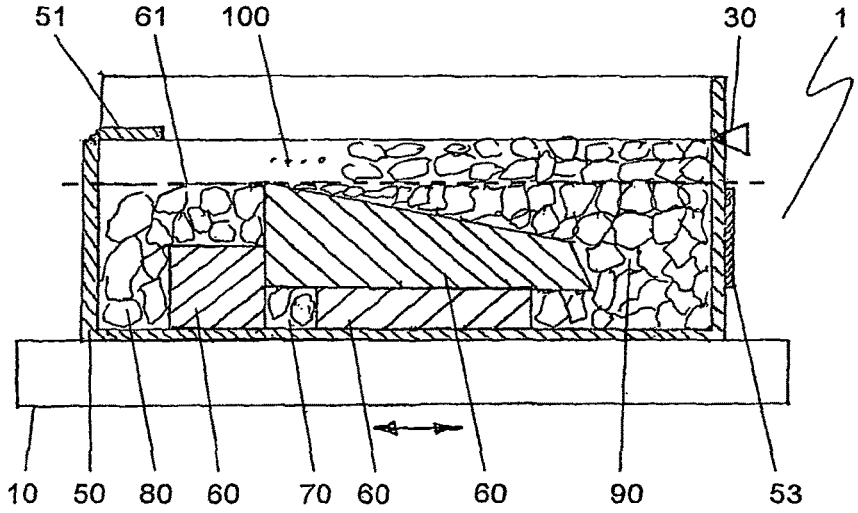
FIG. 2 shows a package as shown in FIG. 1, after the filling procedure.
Figure 3:
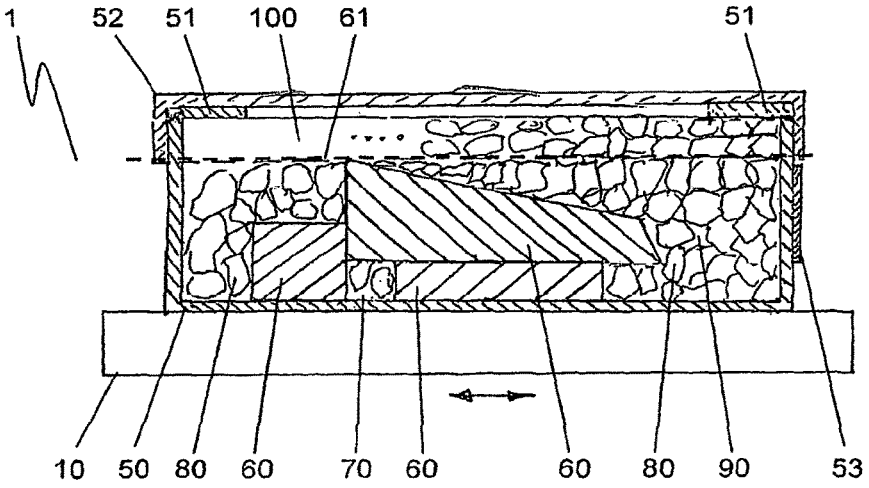
FIG. 3 shows the package when completely closed.

FIGS. 1-3 show details of a schematic depiction of a device, embodied in the form of a cavity-filling system 1, for filling packages 50 or containers with cushioning material 80, which is in particular embodied in the form of foam peanuts, such as composed of a recyclable foam material, which is embodied as essentially cylindrical and has a diameter in the range from 10 mm to 20 mm and a length of 10 mm to 50 mm. The figures depict the individual steps of the method.

FIGS. 1-3 show the device, which can have a support frame that comprises frame profiles. The support frame has a transport device 10 built into it, which can include a multitude of transport rollers by which the packages 50 or containers can be guided. The support frame also has a filling unit built into it, which is composed of or comprises a metering unit and a supply unit (not shown) with which the cushioning material 80 can be dispensed into the package 50 or the container.

The package 50 or container generally has one or more packaged items 60, which must be cushioned and secured for transport so that they do not slide in the package 50 or the container. Between the packaged items 60 or due to the geometry of the packaged items 60, there can also be cavities 70 that it is also necessary to fill.

By means of or with a scanning unit 20, it is possible to determine the contour properties of one or more packaged items 60 in the package 50 or container, based on which a logic unit, such as in the form of an industrial PC, can calculate a volume of the packaged items 60 and based on this, a determination is made as to a filling quantity of the volume of the package 50 or the container. This information is used to control the metering unit of the supply unit so that a variable quantity of cushioning material 80 can be dispensed into the package 50 or the container.

According to this invention, the device has a reading unit 40 that is able to detect information regarding the type and, derived from this, information regarding the internal volume of the package 50 or the container. The information regarding the type and internal volume provided on the package 50 or container can be embodied as a machine-readable code 53 in the form of a printed or glued-on bar code or a 2-D pixel code or an RFID chip attached to the package 50 or the container. The reading unit 40 is designed as a corresponding reading device, such as a bar code scanner or the like, the reading unit 40 transmits the determined data to the logic unit.

The scanning unit 20 can be embodied in the form of an optical laser scanner or line scanner that can use a triangulation method to determine the volume of the packaged item 60 or packaged items 60 and a highest point 61 of the packaged item 60 or packaged items 60. Based on the information regarding the internal volume of the package 50 or the container and the information regarding the volume of the packaged item 60 or packaged items 60, it is possible to determine a first filling volume 90 of cushioning material 80 necessary for filling up to the highest point 61 of the packaged item 60 or packaged items 60.

In a second step, as provided in the method according to the invention, a second filling volume 100, beyond the highest point 61, is determined and based on the filling volume 90 determined in the first step, a total volume is calculated as a sum of the two filling volumes 90, 100 of the cushioning material 80 and the total volume of the cushioning material 80 is dispensed into the package 50 or the container, as shown in FIG. 2. The second filling volume 100 can be predetermined taking into account a filling material density and/or the property of the packaged item 60 or packaged items 60. The predetermined values can be stored in a memory unit of the logic unit.

In another step, after being filled with the cushioning material 80, the package 50 or the container is set into a vibrating motion for a particular time. A vibrating unit is used for this, which can be controlled by the logic unit.

Optionally, as indicated in FIG. 2, it is possible for the package 50, which is composed of a scorable cardboard, to be scored from the outside, the flaps 51 thus produced can be folded inward and a fitted lid 52 for closing the package 50 can be set in place, such as shown in FIG. 3. Thus, the device has a scoring device 30, which can be controlled by the logic unit.

In addition, the device can be equipped with electromechanical or electropneumatic units for folding flaps 51 produced by scoring the package 50 composed of or of cardboard as well as units for placing the fitted lid 52 onto the package 50, which units can likewise be controlled by the logic unit. A corresponding control logic in the form of a process control can be implemented in the logic unit, thus making it possible to implement a fully automated filling of packages 50 or containers as well as a closing of the packages 50.

The invention claimed is:

1. A device for filling packages (50) or containers with a cushioning material (80); the cushioning material (80) supplied to the package (50) or container by a supply unit; contour properties of one or more packaged items (60) in the package (50) or container are determined by a scanner unit (20), processed by a logic unit, and determine a filling quantity of the volume of the package (50) or container to be filled and derive a variable quantity of cushioning material (80) to be dispensed into the package (50) or container, the device comprising a reading unit (40) for determining information regarding the type of package or container and deriving information regarding an internal volume of the package (50) or container; the scanning unit (20) embodied as an optical laser scanner and using a triangulation process to determine a volume of the packaged item (60) or packaged items (60) and a highest point (61) of the packaged item (60) or packaged items (60) and using the highest point (61) and the information regarding the internal volume of the package (50) or container to determine a first filling volume (90) amount of the cushioning material (80) necessary for filling up to the highest point (61) of the packaged item (60) or packaged items (60); wherein a second filling volume (100) amount of the cushioning material (80) for a portion of the interior volume between the highest point (61) and a top of the internal volume is determined based on the information regarding the type of package or container and the internal volume, the second filling volume (100) amount is adjusted according to a predetermined customer-specific instruction as a function of the second filling volume (100) amount and/or a weight of the packaged item (60) or packaged items (60), and, based on the first filling volume (90) amount determined in the first step, the logic unit calculates a total volume of the cushioning material (80) as a sum of the first and the second filling volume (90, 100) amounts and the information regarding the calculated total volume of the cushioning material (80) is transmitted to a metering unit of the supply unit.

2. The device according to claim 1, wherein the information regarding the type of package or container and the internal volume of the package (50) or container can be embodied as a machine-readable code (53) in a form of a printed or a glued-on bar code or a 2-D pixel code or an RFID chip attached to the package (50) or container and a reading unit (40) embodied as a corresponding reading device, and the reading unit (40) communicating with the logic unit.

3. The device according to claim 1, wherein the second filling volume (100) is predetermined as a function of a filling material density and/or the property of the packaged item (60) or packaged items (60) and the predetermined values are stored in a memory unit of the logic unit.

4. The device according to claim 3, wherein the device has a vibrating unit controlled by the logic unit.

5. The device according to claim 4, wherein the device has a scoring device (30) for externally scoring the package (50) of cardboard on an outward face of the package cardboard controlled by the logic unit.

6. The device according to claim 5, wherein the device has electromechanical or electropneumatic units for folding flaps (51) produced by scoring the package (50) of cardboard and for placing a fitted cover (52) onto the package (50), wherein the units are controlled by the logic unit.

7. The device according to claim 1, wherein the second filling volume (100) is predetermined as a function of a filling material density and/or the property of the packaged item (60) or packaged items (60) and the predetermined values are stored in a memory unit of the logic unit.

8. The device according to claim 1, wherein the device has a vibrating unit controlled by the logic unit.

9. The device according to claim 1, wherein the device has a scoring device (30) for externally scoring the package (50) of cardboard controlled by the logic unit.

10. A method for filling packages or containers with a cushioning material (80) being supplied to a package or container by a supply unit, the method comprising:

determining an internal volume of the package or container by reading an information carrier on the package or container with a reading unit (40), wherein the information carrier includes predetermined information comprising the internal volume of the package or container;

automatically determining contour properties of a packaged item (60) or packaged items (60) within the internal volume, wherein the contour properties of the one or more packaged items (60) in the package or container are determined by a scanning unit (20) and processed by a logic unit;

automatically determining a highest point (61) of the packaged item (60) or packaged items (60) from the contour properties of the packaged item (60) or packaged items (60);

automatically determining in a first step a first filling volume (90) amount of the cushioning material (80) necessary for filling up to the highest point (61) of the packaged item (60) or packaged items (60) using the highest point (61), the contour properties, and the predetermined information regarding the internal volume of the package or container;

automatically determining in a second step a second filling volume (100) amount of the cushioning material (80) for a portion of the interior volume between the highest point (61) and a top of the internal volume using the highest point (61) and the predetermined information regarding the internal volume of the package or container;

automatically calculating a total volume of the cushioning material (80) from or as a sum of the first and the second filling volume (90, 100) amounts;

dispensing the cushioning material (80) into the package or container in an amount corresponding to the total volume; and adjusting the second filling volume (100) amount prior to the calculating the total volume, according to a predetermined customer-specific instruction as a function of the second filling volume (100) amount and/or a weight of the packaged item (60) or packaged items (60).

11. The method according to claim 10, wherein the second filling volume (100) amount is determined as a function of a filling material density and/or the property of the packaged item (60) or packaged items (60).

12. The method according to claim 11, wherein in another step after being filled with the cushioning material (80), the package (50) or container is set into a vibrating motion for a certain amount of time.

13. The method according to claim 12, wherein the package (50) is of a scorable cardboard, the method further comprising externally scoring the package cardboard on an outward face of the package (50) and producing flaps (51) folded inward, and positioning a fitted lid (52) for closing the package (50).

14. The method according to claim 11, wherein the property of the packaged item (60) or packaged items (60) is package weight.

15. The method according to claim 10, wherein in another step after being filled with the cushioning material (80), the package (50) or container is set into a vibrating motion for a certain amount of time.

16. The method according to claim 10, wherein the package (50) is of a scorable cardboard scored from an outside and producing flaps (51) folded inward, and a fitted lid (52) positioned for closing the package (50).

17. The method according to claim 10, wherein a machine-readable code (53) in the form of a bar code or a 2-D pixel code or an RFID chip is the information carrier on the package (50) or container.

18. The method according to claim 10, wherein the cushioning material (80) is of foam peanuts of a recyclable foam material having a diameter in a first range from 10 mm to 20 mm and a length in a second range from 10 mm to 50 mm.

19. The method according to claim 10, further comprising automatically increasing a density of the cushioning material (80) as a function of the second filling volume (100) amount and/or a weight of the packaged item (60) or packaged items (60).

* * * * *